US011078758B2

(12) United States Patent
Arteaga et al.

(10) Patent No.: US 11,078,758 B2
(45) Date of Patent: Aug. 3, 2021

(54) PRESSURE CONTROL EQUIPMENT SYSTEMS AND METHODS

(71) Applicant: Cameron International Corporation, Houston, TX (US)

(72) Inventors: Nicolas Arteaga, Jersey Village, TX (US); Emmanuel Guilhamon, Houston, TX (US); Erwan Olliero, Houston, TX (US); Silvestre Meza, Houston, TX (US); Vikas Rakhunde, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 233 days.

(21) Appl. No.: 16/100,121

(22) Filed: Aug. 9, 2018

(65) Prior Publication Data

US 2020/0048991 A1 Feb. 13, 2020

(51) Int. Cl.

| | |
|---|---|
| ***E21B 41/00*** | (2006.01) |
| ***E21B 33/06*** | (2006.01) |
| ***E21B 19/00*** | (2006.01) |
| ***E21B 19/12*** | (2006.01) |
| ***E21B 47/10*** | (2012.01) |
| ***E21B 47/06*** | (2012.01) |

(52) U.S. Cl.

CPC ..... *E21B 41/0092* (2013.01); *E21B 19/008* (2013.01); *E21B 19/12* (2013.01); *E21B 33/062* (2013.01); *E21B 47/06* (2013.01); *E21B 47/10* (2013.01); *E21B 33/063* (2013.01)

(58) Field of Classification Search

CPC .. E21B 33/0355; E21B 33/062; E21B 19/008; E21B 19/12; E21B 47/10; E21B 47/06; E21B 33/063; E21B 33/072

See application file for complete search history.

(56) References Cited

U.S. PATENT DOCUMENTS

| | | | | |
|---|---|---|---|---|
| 4,825,953 | A | 5/1989 | Wong et al. | |
| 6,164,619 | A | 12/2000 | Wayne et al. | |
| 6,305,471 | B1 * | 10/2001 | Milloy | E21B 33/072 166/250.15 |
| 6,394,460 | B1 | 5/2002 | Leggett et al. | |
| 6,676,103 | B2 | 1/2004 | Wood | |
| 6,845,958 | B2 | 1/2005 | Wood et al. | |
| 7,464,765 | B2 | 12/2008 | Isaacks et al. | |
| 7,611,120 | B2 | 11/2009 | Wood | |
| 8,443,878 | B2 | 5/2013 | McCollin | |

(Continued)

FOREIGN PATENT DOCUMENTS

| | | | | |
|---|---|---|---|---|
| GB | 2499737 A | 8/2013 | | |
| WO | WO-2015104173 A2 * | 7/2015 | | E21B 34/02 |
| WO | WO-2018026744 A1 * | 2/2018 | | E21B 23/14 |

OTHER PUBLICATIONS

International Preliminary Report on Patentability issued in International Patent application PCT/US2019/043131, dated Feb. 9, 2021, 8 pages.

*Primary Examiner* — Bickey Dhakal

(74) *Attorney, Agent, or Firm* — Jeffrey D. Frantz

(57) ABSTRACT

A system includes one or more processors configured to provide one or more control signals to cause supply of electric power from a power supply to one or more electric actuators. The one or more electric actuators are configured to adjust one or more components of a cable pressure control equipment (PCE) stack.

14 Claims, 7 Drawing Sheets

(56) References Cited

U.S. PATENT DOCUMENTS

| | | | | |
|---|---|---|---|---|
| 8,567,490 | B2 | 10/2013 | Van Winkle | |
| 8,770,274 | B2 | 7/2014 | Van Winkle | |
| 9,644,447 | B2 | 5/2017 | Joensen et al. | |
| 2014/0158380 | A1* | 6/2014 | Varkey | E21B 17/206 166/386 |
| 2014/0174727 | A1 | 6/2014 | Huizer | |
| 2016/0003033 | A1 | 1/2016 | Coles et al. | |
| 2018/0135366 | A1* | 5/2018 | Olsen | E21B 34/04 |
| 2018/0355682 | A1* | 12/2018 | Pessin | H01B 7/0009 |
| 2019/0203575 | A1* | 7/2019 | Schlosser | G01L 5/047 |

* cited by examiner

PRESSURE CONTROL EQUIPMENT SYSTEMS AND METHODS

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Natural resources, such as oil and gas, are used as fuel to power vehicles, heat homes, and generate electricity, in addition to a myriad of other uses. Once a desired resource is discovered below the surface of the earth, drilling and production systems are often employed to access and extract the resource. These systems may be located onshore or offshore depending on the location of a desired resource. Such systems generally include a wellhead assembly through which the resource is extracted. At various times, operations may be carried out to inspect or to service the well, for example. During these operations, pressure control equipment is mounted above the wellhead to protect other surface equipment from surges in pressure within the wellbore or to carry out other supportive functions.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

Figure 1:
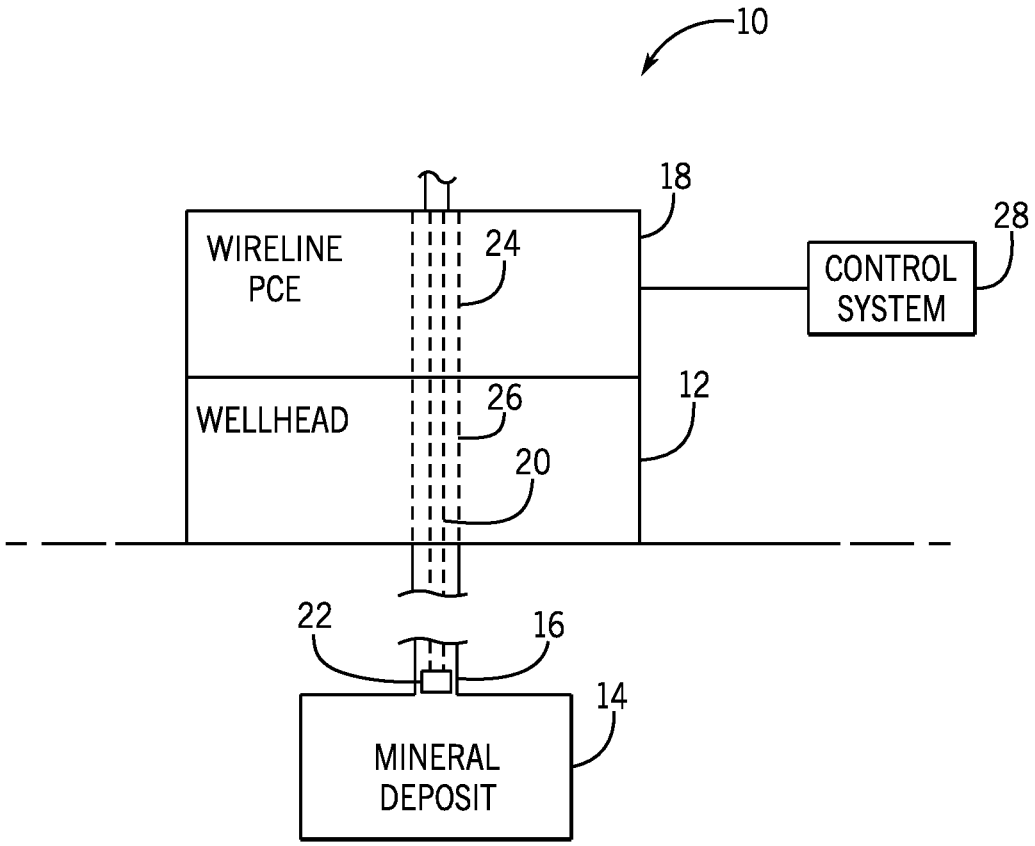
FIG. 1 is a schematic diagram of an embodiment of an offshore system having a pressure control equipment (PCE) stack of the disclosure.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure. In the present disclosure, the terms wireline, Streamline™, slickline, coiled tubing, or other spoolable rod will all be considered a communication conduit and "conduit" or "wireline" or "cable" terms will be used in the following paragraphs as generally referring to any of these conduits used with the described pressure control equipment.

The present embodiments generally relate to wireline pressure control equipment (PCE) systems and methods. Wireline PCE stacks are coupled to and/or positioned vertically above a wellhead during wireline operations in which a tool supported on a wireline is lowered through the wireline PCE stack to enable inspection and/or maintenance of a well, for example. The wireline PCE stack includes components that seal about the wireline as it moves relative to the wireline PCE stack. The wireline PCE stack may isolate the environment, as well as other surface equipment, from pressurized fluid within the well.

With some existing wireline PCE stacks, an operator may provide manual inputs to control a hydraulic actuator to adjust components of the wireline PCE stack. However, such existing wireline PCE stacks may be large, inefficient, and/or expensive to operate due to the use of hydraulic actuators and/or due to involvement of the operator, for example. Accordingly, the present embodiments include a control system (e.g., electronic control system) for the wireline PCE stack. Additionally, one or more electric actuators may be controlled by the control system to adjust components of the wireline PCE stack. The control system may control the electric actuators based on signals received from one or more sensors positioned about the wireline PCE stack, thereby enabling automated operation (e.g., automatic actuation based on signals received from one or more sensors) of the wireline PCE stack. For example, a position sensor (e.g., any suitable sensor or switch, such as a pressure switch, capable of detecting the position of an object) may be located within a tool trap of the wireline PCE stack. The position sensor may detect that a plate of the tool trap is in an open position due to passage of the tool through the tool trap, and the position sensor may provide a signal to a controller of the control system. In response to receipt of the signal, the controller may adjust a winch to withdraw the wireline at a slower rate to block the winch from pulling the wireline out of the wireline PCE stack and/or to facilitate catching the tool with a tool catcher of the wireline PCE stack.

In certain embodiments, some or all of the actuators are electric actuators and/or the wireline PCE stack is devoid of other types of actuators (e.g., hydraulic or pneumatic). Compared to these other types of actuators, the disclosed configuration may advantageously enable faster actuation times (e.g., faster opening and closing times) and eliminate temperature sensitivity due to use of hydraulic fluids. Furthermore, electric actuators may generally be lighter and smaller, and thus may advantageously enable simplified maintenance, transportation, and installation. The use of electric actuators is particularly useful in combination with the sensors and other automated control features disclosed herein, as the entire system may then be electric and run on electric power. However, while the present embodiments relate to a wireline PCE stack that includes electric actuators controlled via the control system to facilitate discussion, it should be appreciated that an operator may additionally or alternatively provide manual inputs to control one or more of the electric actuators to adjust components of the wireline PCE stack in the manner disclosed herein and/or the control system may be used with other types of actuators, such as pneumatic or hydraulic actuators. For example, in response to detection of the tool passing through the tool trap, the control system may provide an indication (e.g., visual or audible alarm) and/or instructions (e.g., via a display) to the operator to adjust the winch, and the operator may then provide a manual input to control one or more actuators to adjust the winch.

With the foregoing in mind, FIG. 1 is a schematic diagram of an embodiment of an offshore system 10. The offshore system 10 includes a wellhead 12, which is coupled to a mineral deposit 14 via a wellbore 16. The wellhead 12 may include any of a variety of other components such as a spool, a hanger, and a "Christmas" tree. In the illustrated embodiment, a wireline pressure control equipment (PCE) stack 18 (e.g., cable PCE stack) is coupled to the wellhead 12 to facilitate wireline operations, which are carried out by lowering a conduit 20 (e.g., communication conduit, wireline, slickline, spoolable rod, or coiled tubing) and a tool 22 (e.g., configured to collect data about the mineral deposit 14 and/or the wellbore 16) through a bore 24 defined by the wireline PCE stack 18, through a bore 26 defined by the wellhead 12, and into the wellbore 16. As shown, a control system 28 (e.g., an electronic control system) is provided to control and provide power to various components of the wireline PCE stack 18. For example, the control system 28 may control one or more electric actuators based on signals received from one or more sensors positioned about the wireline PCE stack 18.

Figure 2:
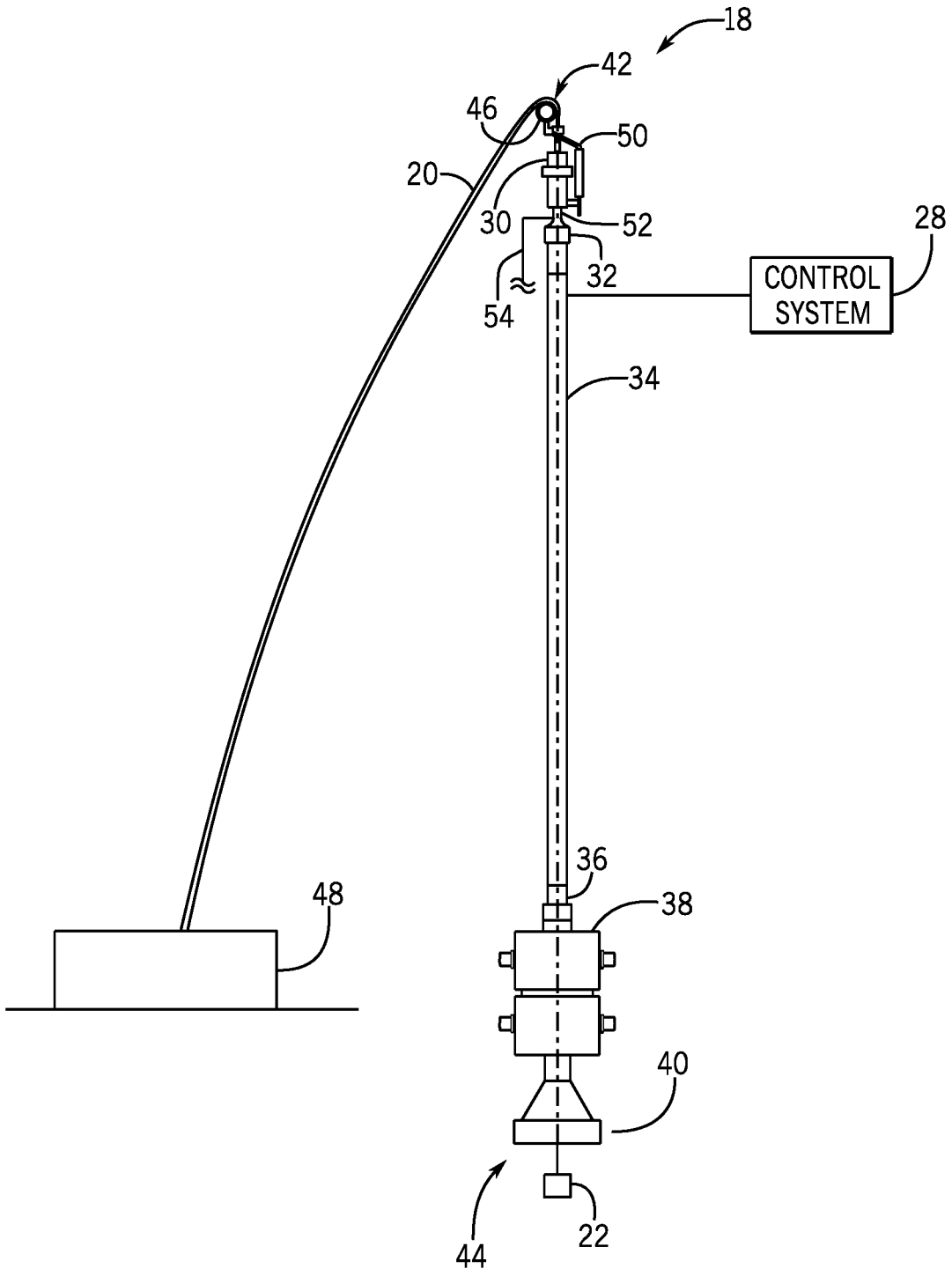
FIG. 2 is a side view of an embodiment of the PCE stack of FIG. 1.

FIG. 2 is a side view of an embodiment of the wireline PCE stack 18 that may be used in the offshore system 10 of FIG. 1. The wireline PCE stack 18 includes various components that enable the wireline PCE stack 18 to seal about the conduit 20 as it moves relative to the wireline PCE stack 18. Thus, the wireline PCE stack 18 may isolate the environment, as well as other surface equipment, from pressurized fluid within the wellbore 16 (FIG. 1).

In the illustrated embodiment, the wireline PCE stack 18 includes a stuffing box 30, a tool catcher 32, a lubricator section 34, a tool trap 36, a blowout preventer (BOP) stack 38 (e.g., wireline valve stack), and a connector 40 to couple the wireline PCE stack 18 to the wellhead 12 (FIG. 1) or other structure. These components are annular structures stacked vertically with respect to one another (e.g., coaxial) to enable the conduit 20 to extend through the wireline PCE stack 18 (e.g., from a first end 42 to a second end 44 of the wireline PCE stack 18) into the wellhead 12. As shown, the conduit 20 extends from the first end 42 of the wireline PCE stack 18 and over a sheave 46 to a winch 48, and rotation of the winch 48 (e.g., a drum or spool of the winch 48) raises and lowers the conduit 20 with the tool 22 through the wireline PCE stack 18. It should be appreciated that the wireline PCE stack 18 may include various other components (e.g., cable tractoring wheels to pull the conduit 20 through the stuffing box 30, a pump-in sub to enable fluid injection). In some embodiments, the wireline PCE stack 18 is devoid of common components (e.g., grease injector system mounted on and/or vertically above the lubricator section 34).

The stuffing box 30 is configured to seal against the conduit 20 (e.g., to seal an annular space about the conduit 20) to block a flow of fluid from the bore 24 (FIG. 1) vertically above the stuffing box 30. In the illustrated embodiment, the stuffing box 30 includes a housing supporting an annular packing material or other compressible annular structure that forms a seal against the conduit 20. In some embodiments, movement of a lever 50 (e.g. bar or other driving component), adjusts a compressive force (e.g., in a vertical direction) on the annular packing material to adjust the seal against the conduit 20. For example, movement of the lever 50 in one direction may squeeze the annular packing material vertically, thereby driving the annular packing material radially (e.g., toward the conduit 20) to increase a surface area and/or an effectiveness of the seal against the conduit 20.

The tool catcher 32 is configured to engage or catch the tool 22 to block the tool 22 from being withdrawn vertically above the tool catcher 32 and/or to block the tool 22 from falling vertically into the wellbore 16. In the illustrated embodiment, the tool catcher 32 includes a plate (e.g., collar or flapper) that adjusts from an open position in which the plate enables the tool 22 to move across the tool catcher 32 and a closed position in which the plate engages the tool 22, thereby blocking movement of the tool 22 across the tool catcher 32.

The lubricator section 34 may include one or more annular pipes joined to one another, and the lubricator section 34 may support or surround the tool 22 while it is withdrawn from the wellbore 16. The tool trap 36 is configured to block the tool 22 from falling vertically into the wellbore 16. In the illustrated embodiment, the tool trap 36 includes a plate (e.g., collar or flapper) that adjusts from an open position in which the plate enables the tool 22 to move across the tool trap 36 and a closed position in which the plate blocks the tool 22 from falling vertically into the wellbore 16. In some embodiments, the plate is biased (e.g., via a biasing member, such as a spring) toward the closed position. During withdrawal of the tool 22 from the wellbore 16, the tool 22 may contact and exert an upward force on the plate to drive the plate to the open position, and the biasing member may return the plate to the closed position after the tool 22 moves vertically above the tool trap 36.

The BOP stack 38 may include one or more BOPs (e.g., wireline valves) that are configured to seal the bore 24. Each BOP may include rams that are configured to move toward one another to seal the bore 24. For example, in some embodiments, one BOP may be a shear ram that is configured to shear the conduit 20 and to seal the bore 24, and one BOP may be a pipe ram that is configured to seal about the wireline 36.

In certain embodiments, one or more ports 52 (e.g., bleed off ports) may be provided along the wireline PCE stack 18, such as proximate to an upper end of the lubricator section 34. For example, in the illustrated embodiment, the one or more ports include a port 52 positioned between the tool catcher 32 and the stuffing box 30. The port 52 fluidly couples a bore of the lubricator section 34 to a drain conduit 54 (e.g., pipe or hose), which may extend to any suitable fluid container, for example. As discussed in more detail below, a valve (e.g., bleed off port valve) may be actuated to adjust fluid flow between the bore of the lubricator section 34 and the drain conduit 54 via the port 52. The port 52 may be utilized to bleed off air trapped within the lubricator section 34.

As discussed in more detail below, some or all of the various components of the wireline PCE stack 18 may be adjusted via electric actuators that are controlled by control signals received from the control system 28. In some embodiments, the wireline PCE stack 18 is devoid of other types of actuators (e.g., hydraulic or pneumatic actuators). Furthermore, one or more sensors may be positioned about the wireline PCE stack 18, the one or more sensors may provide signals indicative of one or more characteristics of the wireline PCE stack 18 to the control system 28, and the control system 28 may generate the control signals based on the signals received from the one or more sensors.

Figure 3:
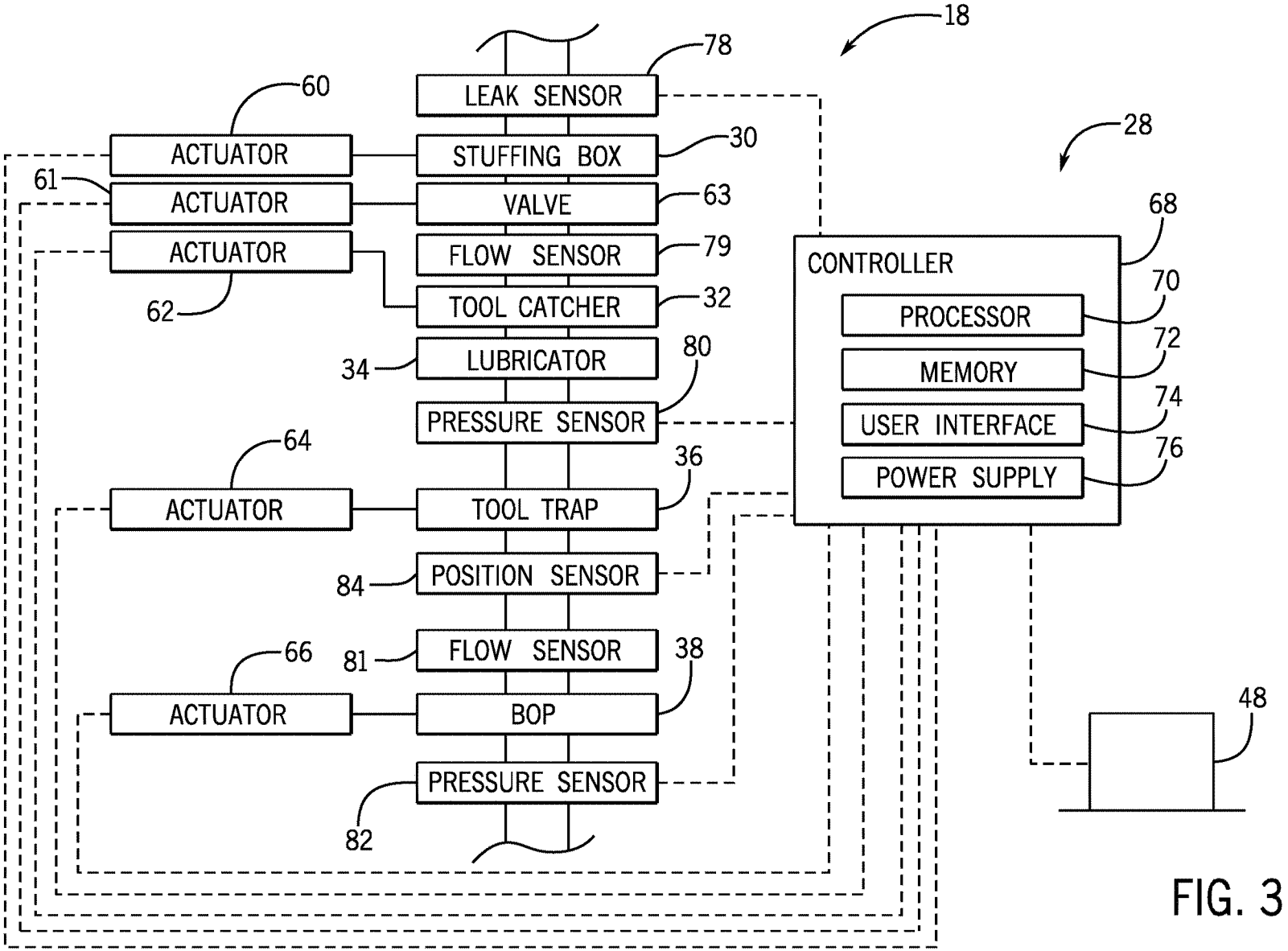
FIG. 3 is a schematic diagram of a control system and the PCE stack of FIG. 1.

FIG. 3 is a schematic diagram of the control system 28 and the wireline PCE stack 18. As shown, a stuffing box actuator 60 is provided to adjust the lever 50 (FIG. 2) of the stuffing box 30, thereby adjusting the seal formed against the conduit 20 (FIG. 2). A bleed off port valve actuator 61 is provided to adjust a valve 63 (e.g., bleed off port valve) between an open position and a closed position to adjust fluid flow between the bore of the lubricator section 34 and the bleed off port 52 (FIG. 2). A tool catcher actuator 62 is provided to adjust the plate of the tool catcher 32 between the open position and the closed position. A tool trap actuator 64 is provided to adjust the plate of the tool trap 36 between the open position and the closed position. A BOP actuator 66 (e.g., wireline actuator) is provided for the BOP assembly 38 (e.g., one or more respective actuators 66 may be provided for each BOP in the BOP assembly 38). One or more of the actuators 60, 61, 62, 64, 66 may be electric actuators that are configured to receive and respond to control signals (e.g., electric voltage or current) from a controller 68 of the control system 28. The winch 48 may also be configured to receive and respond to control signals from the controller 68 of the control system 28. As shown, the controller 68 includes a processor 70, a memory 72, a user interface 74, and a power supply 76 (e.g., electric power supply).

One or more sensors may be positioned about the wireline PCE stack 18 to facilitate the techniques disclosed herein. As shown, a leak sensor 78 is positioned proximate to the stuffing box 30 (e.g., vertically above the stuffing box or within the stuffing box 30) to detect the presence of fluid. In one embodiment, the leak sensor 78 may be an ultrasonic sensor (e.g., acoustic sensor) configured to detect sound waves generated as the conduit 20 contacts and passes through the packing material of the stuffing box 30. The leak sensor 78 may send a signal indicative of the sound waves to the controller 68, and the processor 70 may process the signal to determine whether a leak exists (e.g., fluid is present at or vertically above the packing material and/or at or vertically above the intended location of the seal formed against the conduit 20). In some embodiments, the processor 70 may process the signal to determine a characteristic (e.g., frequency) of the sound waves and then determine whether a leak exists based on the characteristic. More particularly, the processor 70 may compare the characteristic to a known characteristic (e.g., known or predetermined signature, pattern, or number based on modeled data, empirical data from many stuffing boxes 30, or prior data from the same stuffing box 30), and then determine whether a leak exists based on the comparison. For example, if the characteristic varies from the known characteristic by more than a threshold amount or percentage (e.g., 5, 10, or 15 percent) or fails to match a signature, the processor 70 may determine that a leak exists.

In response to determining that the leak exists, the processor 70 may provide a control signal to the actuator 60 to tighten the seal against the conduit 20 (e.g., by adjusting the lever 50). The processor 70 may continue to control the actuator 60 to tighten the seal until feedback from the leak sensor 78 indicates that an acceptable amount of fluid (e.g., no fluid) is present and that the leak is repaired. In this manner, the control system 28 may automatically control the stuffing box 30 based on signals received from the leak sensor 78. If the lever 50 has been adjusted to a limit position (e.g., the lever 50 cannot be further adjusted to tighten the seal against the conduit 20) and the leak is still detected, the processor 70 may provide a control signal to stop the winch 48 to stop movement of the conduit 20 within the wireline PCE stack 18 and then a control signal to one or more actuators 66 to close rams of one or more BOPs of the BOP stack 38, thereby sealing the bore 24 of the wireline PCE stack 18 via the BOP stack 38.

It should be appreciated that the leak sensor 78 may have any of a variety of configurations that enable the leak sensor 78 to detect a leak or the presence of fluid. In some embodiments, the leak sensor 78 may include a camera that provides images to the processor 70, which may process the images via image recognition or template matching techniques to determine whether a leak exists, for example. In some embodiments, the leak sensor 78 may include a conductive element that forms an open circuit in the absence of fluid, and that forms a closed circuit in the presence of fluid (e.g., when the fluid connects two open ends of the conductive element). In such cases, the processor 70 may receive a signal indicative of the status of the circuit (e.g., a resistance value indicative of whether the circuit is open or closed) from the leak sensor 78 and may determine whether a leak exists based on the status of the circuit.

As shown in FIG. 3, a first pressure sensor 80 is positioned vertically above the BOP stack 38 and a second pressure sensor 82 is positioned vertically below the BOP stack 38. More particularly, the first pressure sensor 80 is configured to detect a first pressure within the bore 24 vertically above the BOP stack 38 (e.g., vertically above an uppermost ram of the BOP stack 38), and the second pressure sensor 82 is configured to detect a second pressure within the bore 24 vertically below the BOP stack 38 (e.g., vertically below a lowermost ram of the BOP stack 38). The first and second pressure measurements may be used to evaluate the seal formed by the BOP stack 38. For example, rams of one or more BOPs of the BOP stack 38 may be actuated from the open position to the closed position to the seal the bore 24 at various times (e.g., when the leak sensor 78 indicates a leak that cannot be stopped by the stuffing box 30, upon completion of wireline operations, or upon a sudden increase in pressure in the wellbore 16).

While the rams of one or more BOPs of the BOP stack 38 are in the closed position, the first pressure sensor 80 and the second pressure sensor 82 may send respective signals indicative of the first pressure and the second pressure to the processor 70, and the processor 70 may process the respective signals to determine whether the rams of the one or more BOPs of the BOP stack 38 seal the bore 24. In some embodiments, the processor 70 may process the respective signals to determine the pressure at each location (e.g., the first pressure vertically above and the second pressure vertically below the BOP stack 38) and then determine whether the rams of the one or more BOPs seal the bore 24 based on the pressure at each location. More particularly, the processor 70 may compare the first pressure to the second pressure, and then determine the whether the seal is adequate based on the comparison. For example, if the first pressure and the second pressure are equal or substantially equal (e.g., within 5, 10, 15, 20, or 25 percent of one another), the processor 70 may determine that the seal is inadequate. If the first pressure is less than or substantially less than the second pressure (e.g., less than or equal to 5, 10, 15, 20, or 25 percent of the second pressure), the processor 70 may determine that the seal is adequate.

In response to a determination that the seal is inadequate, the processor 70 may provide a control signal to one or more actuators 66 to adjust the rams of one or more other BOPs of the BOP stack 38 to the closed position. The first pressure and the second pressure may then be compared to one another in the manner set forth above to determine whether the seal is adequate. It should be appreciated that the pressure within the bore 24 vertically above the BOP stack 38 may be vented (e.g., via a pump-in sub) after moving the rams to the closed position and prior to comparing the first pressure to the second pressure to assess the seal formed by the rams of the one or more BOPs of the BOP stack 38. In some embodiments, the pressure sensors 80, 82 may be configured to monitor pressure while the rams of the one or more BOPs of the BOP stack 38 are in an open position, and the tool catcher actuator 62 may be controlled to adjust the tool catcher 32 and/or the winch 48 may be controlled to lower the tool 22 (FIG. 2) through the wireline PCE stack 18 in response to detecting fluid pressure below a threshold pressure, for example.

Figure 4:
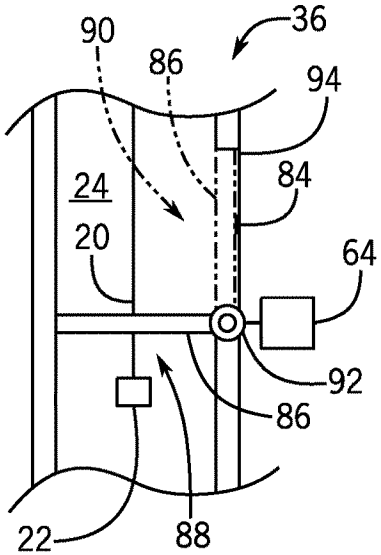
FIG. 4 is a perspective view of a tool trap assembly that may be used in the PCE stack of FIG. 1.

As shown in FIG. 3, a position sensor 84 (e.g., a tool trap sensor) may be located within the tool trap 36 of the wireline PCE stack 18. FIG. 4 illustrates a side view of an embodiment of the tool trap 36 to facilitate discussion. In the disclosed embodiments, the position sensor 84 may be positioned within the tool trap 36 to detect that a plate 86 of the tool trap 36 is in an open position 90 (e.g., a fully open position or a partially open position) due to passage of the tool 22 through the tool trap 36.

In operation, the plate 86 may be actuated via the tool trap actuator 64 to move from a closed position 88 in which the plate 86 is in the bore 24 to block the tool 22 from falling into the wellbore 16 (FIG. 1) to the open position 90 in which the plate 86 is withdrawn from the bore 24 to enable the tool 22 to be lowered into the wellbore 16. The plate 86 may return to the closed position 88 (e.g., via a biasing member) after the tool 22 is lowered into the wellbore 16. During withdrawal of the tool 22 from the wellbore 16, the tool 22 may contact and exert an upward force on the plate 86 to drive the plate 86 to the open position 90, and the plate 86 may return to the closed position 88 (e.g., via the biasing member) after the tool 22 moves vertically above the plate 86. Thus, by monitoring the position of the plate 86 of the tool trap 36, the control system 28 may also indirectly detect the position of the tool 22 (e.g., relative to the tool trap 36, such as vertically below or vertically above the tool trap 26).

More particularly, the position sensor 84 may send a signal indicative of the position of the plate 86 of the tool trap 36 to the controller 68, and the processor 70 may process the signal to determine whether the plate 86 is being driven (e.g., is or was driven) to the open position 90 by the tool 22. The processor 70 may also consider signals that indicate that the tool 22 is being withdrawn via the winch 48 and/or that the tool trap actuator 64 is not adjusting the plate 86 to the open position 90. For example, the processor 70 may determine that the plate 86 is being driven to the open position 90 by the tool 22 if the plate 86 moves toward or reaches the open position 90 while the tool 22 is being withdrawn.

In response to determining that the plate 86 is being driven to the open position 90 by the tool 22, the processor 70 may provide a control signal to a winch actuator (e.g., motor or other drive source) of the winch 48 to adjust (e.g., slow or reduce) the rate at which the conduit 20 and the tool 22 are withdrawn from the wireline PCE stack 18. Such techniques may block the winch 48 from pulling the conduit 20 out of the wireline PCE stack 18 and/or may facilitate catching the tool 22 with the tool catcher 32, such as by reducing the force with which the tool 22 impacts the plate of the tool catcher 32, for example.

It should be appreciated that the position sensor 84 may be any suitable sensor or switch, such as a pressure switch, capable of detecting the position of the plate 86 of the tool trap 36 and/or motion of the plate 86 within the tool trap 36. It should also be appreciated that optical sensors, cameras, or acoustic sensors may be utilized to detect the position of the plate 86 of the tool trap 36. For example, optical sensors or acoustic sensors may detect an interruption in light or sound waves within the tool trap 26 due to the plate 86 being in the open position 90. The position sensor 84 may be mounted to or supported by a housing 94 (e.g., an annular wall of an annular housing), as shown, or the position sensor 84 may be mounted to or supported on the plate 86. Furthermore, the position sensor 84 may additionally or alternatively be configured to directly monitor the position of the tool 22 or to detect the tool 22 as it passes through the tool trap 36. The tool trap 36 illustrated in FIG. 4 includes one plate 86 supported on a pivot rod 92 that is driven to rotate via the tool trap actuator 64. However, it should be appreciated that the plate 86 may move into and out of the bore 24 without rotation and/or the tool trap 36 may include multiple plates 86 (e.g., two opposed plates).

The controller 68 may be configured to provide various outputs or indications (e.g., audible alarms, text messages) to the operator and/or may allow the operator to provide various inputs to control the various components of the wireline PCE stack 18. For example, the controller 68 may instruct the user interface 74 to display the data collected by the leak sensor 78, the first pressure sensor 80, the second pressure sensor 82, and/or the position sensor 84. Additionally or alternatively, the controller 68 may instruct the user interface 74 to display information indicative of the determined information, such as whether a leak at the leak sensor 82 exists, whether the seal formed by the BOP stack 38 is adequate, and/or whether the tool 22 has moved across the tool trap 36 during withdrawal of the tool 22 through the wireline PCE stack 18.

Additionally or alternatively, the controller 68 may instruct the user interface 74 to display the actions or responses instructed by the controller 68, such as the response to control the stuffing box actuator 60 to adjust the lever 50 to adjust the seal at the stuffing box 30, the adjustment of rams of another BOP of the BOP stack 38 to the closed position, and/or the adjustment of the winch 48 following detection of the tool 22 within the tool trap 36. The user interface 74 may also enable the operator to control various components of the wireline PCE stack 18, such as in the various ways disclosed herein. For example, the operator may provide an input that causes the controller 68 to adjust the stuffing box actuator 60 to adjust the lever 50 to adjust the seal at the stuffing box 30. The controller 68 also includes the power supply 76 that provides power (e.g., electric power) to operate the controller 68, as well as to provide the control signals (e.g., electric voltage or current) to the actuators 60, 62, 64, 66 to actuate the various components of the wireline PCE stack 18. The processor 70 may provide power control signals to instruct and/or to regulate the supply of the electric power from the power supply 76 to the actuators 60, 62, 64, 66. For example, the processor 70 may provide the power control signal to cause the power supply 76 to direct an appropriate amount of electric power to one of the actuators 60, 62, 64, 66 at a particular time.

It should be appreciated that the controller 68 may include various other components, such as a communication device that is capable of communicating the data or the other information to various other devices (e.g., a remote computing system). It should also be appreciated that the processor 70 may include one or more processors that may be used to execute instructions or software. The memory 72 may include a volatile memory, such as random access memory (RAM), and/or a nonvolatile memory, such as ROM. The memory 72 may store a variety of information and may be used for various purposes. For example, the memory 72 may store processor-executable instructions (e.g., firmware or software) for the processor 70 to execute, such as instructions for processing the signals from the one or more sensors to determine characteristics of the wireline PCE stack 18.

As noted above, the wireline PCE stack 18 may include the port 52 (FIG. 2) and associated components, such as the valve 63 and the actuator 61, that facilitate operations to bleed off trapped air within the wireline PCE stack 18 (e.g., within the bore of the lubricator section 34). In some embodiments, a first flow sensor 79 that is configured to detect fluid flow (e.g., a fluid flow rate) proximate to or within the port 52 (FIG. 2) may be used with the wireline PCE stack 18.

During operation, air may become trapped within the wireline PCE stack 18. This trapped air may be detected by one or more sensors within the wireline PCE stack 18 or via other techniques. When trapped air is detected (e.g., by the processor 70, such as based on measurements obtained by one or more sensors), the port 52, the bleed off bleed off port valve actuator 61, and the valve 63 may be utilized to bleed off the trapped air. For example, upon detection of trapped air, the processor 70 may provide a control signal to the actuator 61 to adjust the valve 63 to the open position. The processor 70 may also provide a control signal to one or more actuators 66 to adjust the rams of one or more BOPs of the BOP stack 38 to the closed position, and the processor 70 may further provide a control signal to a pump or other device to provide fluid into the lubricator section 34, such as through another port in the wireline PCE stack 18.

Then, once the lubricator section 34 fills with the fluid, the fluid will flow through the port 52 and will be detectable by the first flow sensor 79. The first flow sensor 79 may send a signal indicative of the fluid to the controller 68, and the processor 70 may process the signal to determine whether the fluid is present at the port 52 [FIG. 2]). In response to determining that the fluid is present at the port 52 and/or that the trapped air has been released through the port 52, the processor 70 may provide a control signal to the bleed off port valve actuator 61 to adjust the valve 63 to the closed position, the processor 70 may provide a control signal to one or more actuators 66 to adjust the rams of one or more BOPs of the BOP stack 38 to the open position, and/or the processor 70 may provide a control signal to the actuator 60 to tighten the seal of the stuffing box 30 against the conduit 20 (e.g., by adjusting the lever 50) to resume other types of operations.

In some embodiments, a second flow sensor 81 may be provided proximate to the BOP stack 38, such as vertically above the BOP stack 38. In some embodiments, the second flow sensor 81 may be integrated into or supported within the BOP stack 38. The second flow sensor 81 may measure fluid flow through the BOP stack 38, such as fluid flow of fluid intentionally routed through a manifold of the BOP stack 38 to balance pressure across a closed ram and/or fluid flow of fluid through the bore 24 of the BOP stack 38.

These fluid flow measurements may be used to confirm flow of the intentionally routed fluid and/or to evaluate the seal formed by the BOP stack 38. For example, rams of one or more BOPs of the BOP stack 38 may be actuated from the open position to the closed position to the seal the bore 24 at various times (e.g., when the leak sensor 78 indicates a leak that cannot be stopped by the stuffing box 30, upon completion of wireline operations, or upon a sudden increase in pressure in the wellbore 16). While the rams of one or more BOPs of the BOP stack 38 are in the closed position, the second fluid sensor 81 may send a signal indicative of the fluid flow to the processor 70, and the processor 70 may process the signal to determine whether the rams of the one or more BOPs of the BOP stack 38 seal the bore 24. As noted above with respect the discussion of the pressure sensors 82, 84, in response to a determination that the seal is inadequate, the processor 70 may provide a control signal to one or more actuators 66 to adjust the rams of one or more other BOPs of the BOP stack 38 to the closed position. Similarly, fluid flow measurements obtained by the first fluid flow sensor 79 may be utilized to detect fluid flow vertically above the BOP stack 38, and thus, may be used to determine whether the rams of the one or more BOPs of the BOP stack 38 seal the bore 24 and/or to facilitate adjustment of additional rams to the closed position to seal the bore 24.

It should be appreciated that flow sensors may be provided to detect fluid flow at various locations the wireline PCE stack 18, such as one or more additional flow sensors at the port 52, one or more flow sensors vertically below the BOP stack 38, and/or one or more additional flow sensors vertically above the BOP stack 38 and/or within the BOP stack 38 to carry out the techniques disclosed herein. Furthermore, the flow sensors 79, 81 may be used to facilitate various other operations. For example, a flow sensor may be positioned proximate to the stuffing box 30 (e.g., vertically above the stuffing box or within the stuffing box 30) to detect fluid flow across the stuffing box 30, and the fluid flow measurements obtained by the flow sensor may be utilized to trigger various actions similar to those described above with respect to the leak sensor (e.g., determine whether a leak exists and control the actuator 60 to tighten the seal of the stuffing box 30). In some embodiments, the flow sensors (e.g., the flow sensors 79, 81 or other flow sensors) may be configured to monitor flow while the rams of the one or more BOPs of the BOP stack 38 are in an open position, and the tool catcher actuator 62 may be controlled to adjust the tool catcher 32 and/or the winch 48 may be controlled to lower the tool 22 (FIG. 2) through the wireline PCE stack 18 in response to detecting fluid flow below a threshold flow rate (e.g., no flow), for example. The flow sensors disclosed herein may be any suitable type of flow sensors, such as ultrasonic flow sensors, for example. It should be appreciated that flow sensors disclosed herein may be capable of distinguishing between air and fluid, thereby facilitating determination and control steps performed by the processor 70.

Figure 5:
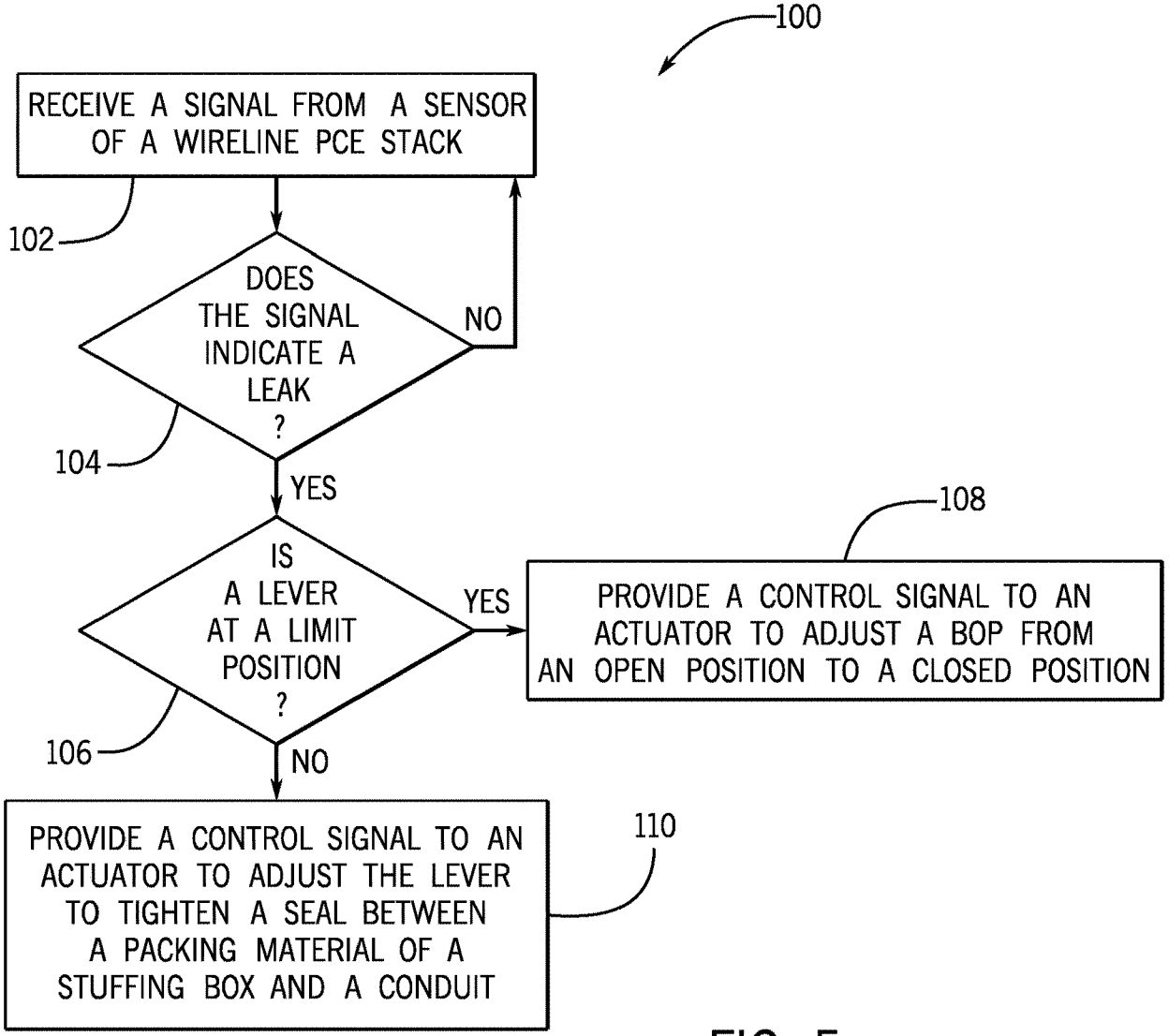
FIG. 5 is a flow diagram of an embodiment of a method of operating the PCE stack of FIG. 1 based on a signal received from a leak sensor.
Figure 6:
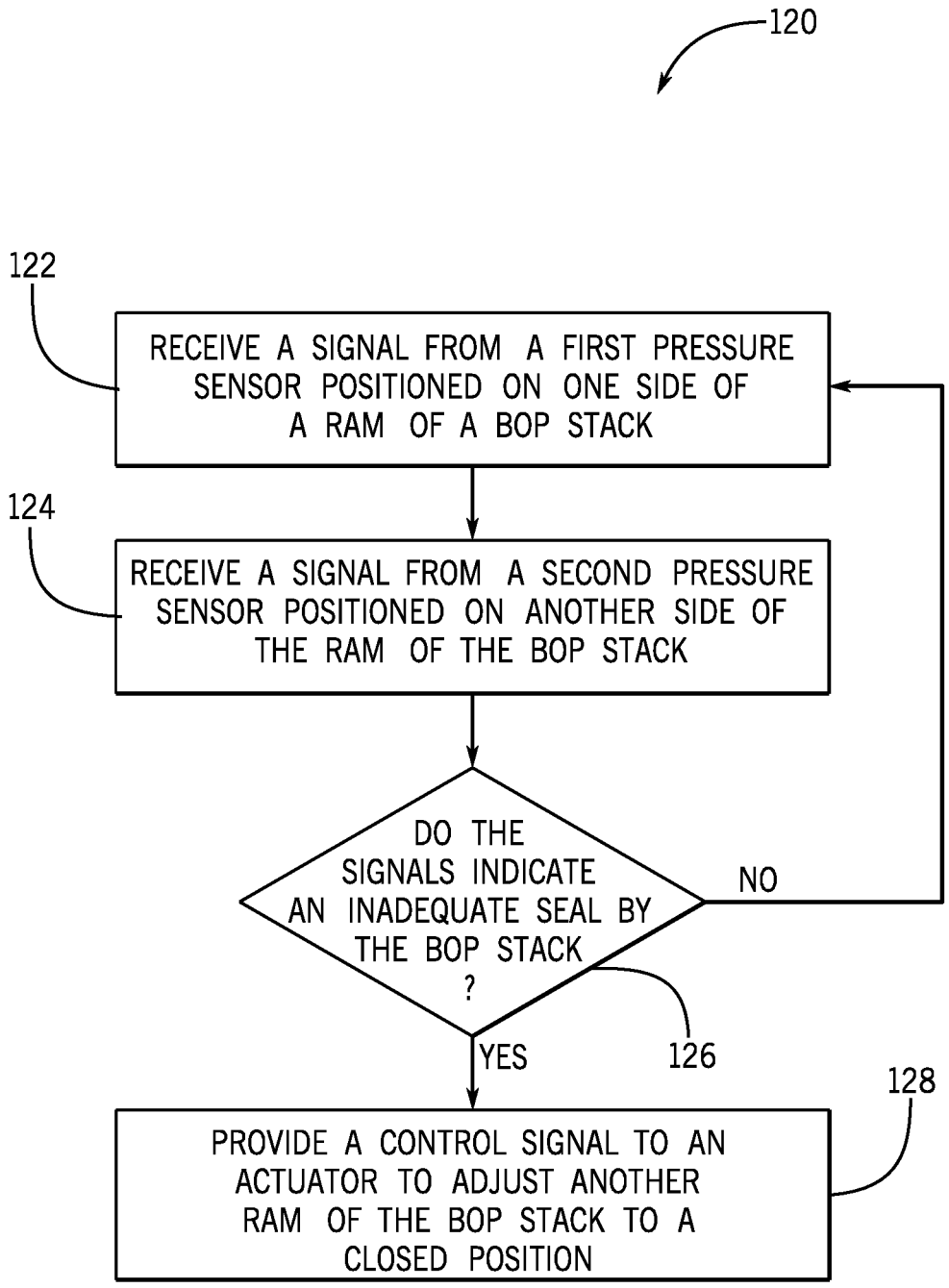
FIG. 6 flow diagram of an embodiment of a method of operating the PCE stack of FIG. 1 based on a signal received from pressure sensors.
Figure 7:
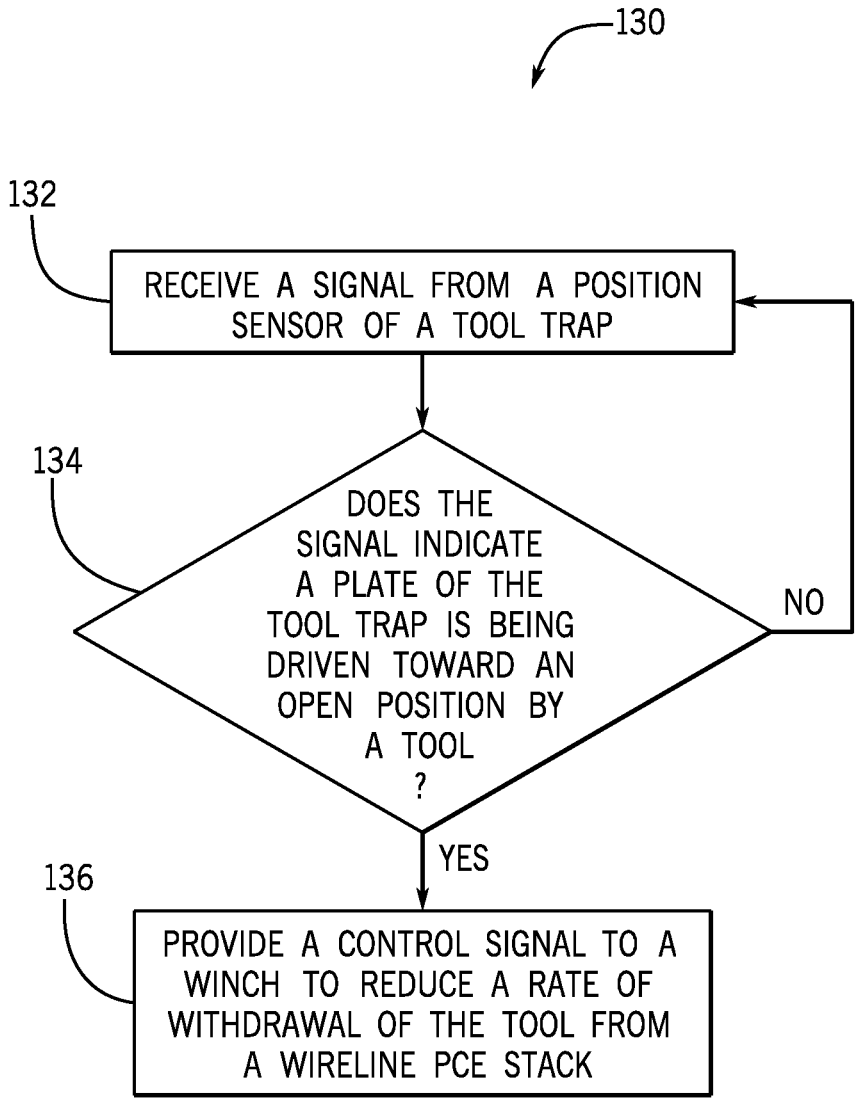
FIG. 7 is flow diagram of an embodiment of a method of operating the PCE stack of FIG. 1 based on a signal received from a position sensor.

FIGS. 5-7 are flow diagrams of embodiments of methods of operating the wireline PCE stack 18. The methods include non-limiting examples of using the one or more processors to provide one or more control signals to cause supply of electric power from the power supply to one or more electric actuators that are configured to adjust one or more components of the wireline PCE stack. The methods disclosed herein includes various steps represented by blocks. It should be noted that at least some steps of the methods may be performed as an automated procedure by a system, such as the control system 28. Although the flow charts illustrate the steps in a certain sequence, it should be understood that the steps may be performed in any suitable order and certain steps may be carried out simultaneously, where appropriate. Additionally, steps may be added to or omitted from of the methods. Further, certain steps or portions of the methods may be performed by separate devices. For example, a first portion of each method may be performed by the processor 70, while a second portion of the methods may be performed by another processor or an operator. In addition, insofar as steps of the methods disclosed herein are applied to received signals, it should be understood that the received signals may be raw signals or processed signals. That is, the methods may be applied to an output of the received signals.

FIG. 5 is a flow diagram of an embodiment of a method 100 of operating the wireline PCE stack 18 based on a signal received from the leak sensor 78. As shown, in step 102, the processor 70 may receive a signal from the leak sensor 78 positioned proximate to the stuffing box 30 of the wireline PCE stack 18. In step 104, the processor 70 may determine whether the signal indicates a leak. For example, the leak sensor 78 may be an ultrasonic sensor and the signal may be indicative of sound waves generated as the conduit 20 passes through the packing material of the stuffing box 40. The processor 70 may determine a characteristic of the sound waves and then may compare the characteristic to a known characteristic to determine whether the signal indicates a leak.

In response to determining that no leak exists, the method 100 may return to step 102. In response to determining that a leak exists, the method 100 may proceed to step 106. In step 106, the processor 70 may determine whether the packing material of the stuffing box 30 is in a limit position (e.g., based on whether the lever 50 of the stuffing box 30 is in a limit position). For example, because the stuffing box actuator 60 that adjusts the lever 50 is controlled via the controller 68, the processor 70 may readily access or request information indicative of the position of the lever 50, such as from the memory 72 or via a feedback signal indicative of the position of the lever 50 from the stuffing box actuator 62 or other position sensor configured to monitor the position of the lever 50, for example.

In response to determining that the packing material and/or the lever 50 is in the limit position and that the leak exists, the method 100 may proceed to step 108. In step 108, the processor 70 may provide a control signal to the BOP actuator 66 to adjust rams of a BOP of the BOP stack 38 to the closed position to seal the bore 24. The processor 70 may provide a control signal to the winch 48 to stop movement of the conduit 20 prior to step 108.

In response to determining that the packing material and/or lever 50 is not in the limit position 50 and that the leak exists, the method 100 may proceed to step 110. In step 110, the processor 70 may provide a control signal to the stuffing box actuator 60 to adjust the lever 50 to tighten the seal between the packing material of the stuffing box 30 and the conduit 20. It should be appreciated that the method 100 may return to step 102 to continue monitoring for leaks following step 108 or 110. As noted above, various leak sensors may be utilized to enable the disclosed techniques. Because the other mechanisms (e.g., other than the lever 50) may be utilized to tighten the seal formed by the packing material, it should be appreciated that the method may more generally be carried out based on information indicative of whether the packing material is in the limit position (e.g., cannot be tightened or compressed further to improve the seal).

FIG. 6 is a flow diagram of an embodiment of a method 120 of operating the wireline PCE stack 18 based on signals received from the first pressure sensor 80 and the second pressure sensor 82 while rams of a BOP of the BOP stack 28 are in a closed position. As shown, in step 122, the processor 70 may receive a first signal indicative of a first pressure from the first pressure sensor 80 positioned vertically above a ram of the BOP stack 38 of the wireline PCE stack 18. In step 124, the processor 70 may receive a second signal indicative of a second pressure from the second pressure sensor 82 positioned vertically below the ram of the BOP stack 38 of the wireline PCE stack 18.

In step 126, the processor 70 may determine whether the first signal and the second signal indicate a leak across the rams of the BOP stack 38. In some embodiments, the processor 70 may compare the first pressure to the second pressure, and then determine the whether the seal formed by the ram of the BOP stack 38 is adequate based on the comparison. For example, if the first pressure and the second pressure are equal or substantially equal, the processor 70 may determine that the seal is inadequate. If the first pressure is less than or substantially less than the second pressure, the processor 70 may determine that the seal is adequate.

In response to determining that the seal is adequate, the method 120 may return to step 122. In response to determining that the seal is inadequate, the method 120 may proceed to step 128. In step 128, the processor 70 may provide a control signal to the BOP actuator 66 to adjust other rams of the BOP stack 38 to the closed position to seal the bore 24. It should be appreciated that the method 120 may return to step 122 to continue monitoring the seal formed by the BOP stack 38 following step 128.

FIG. 7 is a flow diagram of an embodiment of a method 130 of operating the wireline PCE stack 18 based on signals received from the position sensor 84 of the tool trap 36. As shown, in step 132, the processor 70 may receive a signal indicative of a position of the plate 86 of the tool trap 36 from the position sensor 84. In step 134, the processor 70 may determine whether the signal indicates that the plate 86 of the tool trap 36 is being driven (e.g., is or was driven) to the open position 90 by the tool 22. To assist in the determination, the processor 70 may also consider signals that indicate that the tool 22 is being withdrawn via the winch 48 and/or that the tool trap actuator 64 is not adjusting the plate 86 to the open position 90.

In response to determining that the plate 86 of the tool trap 36 is in the closed position 100 or is in the open position 90 via the tool trap actuator 64, for example, the method 130 may return to step 132. In response to determining that the plate 86 of the tool trap 36 is being driven to the open position 90 by the tool 22, the method 130 may proceed to step 136. In step 136, the processor 70 may provide a control signal to the winch 48 to adjust (e.g., reduce) a rate at which the winch 48 withdraws the conduit 20 and the tool 22 from the wireline PCE stack 18. As noted above, various position sensors may be utilized to enable the disclosed techniques.

Figure 8:
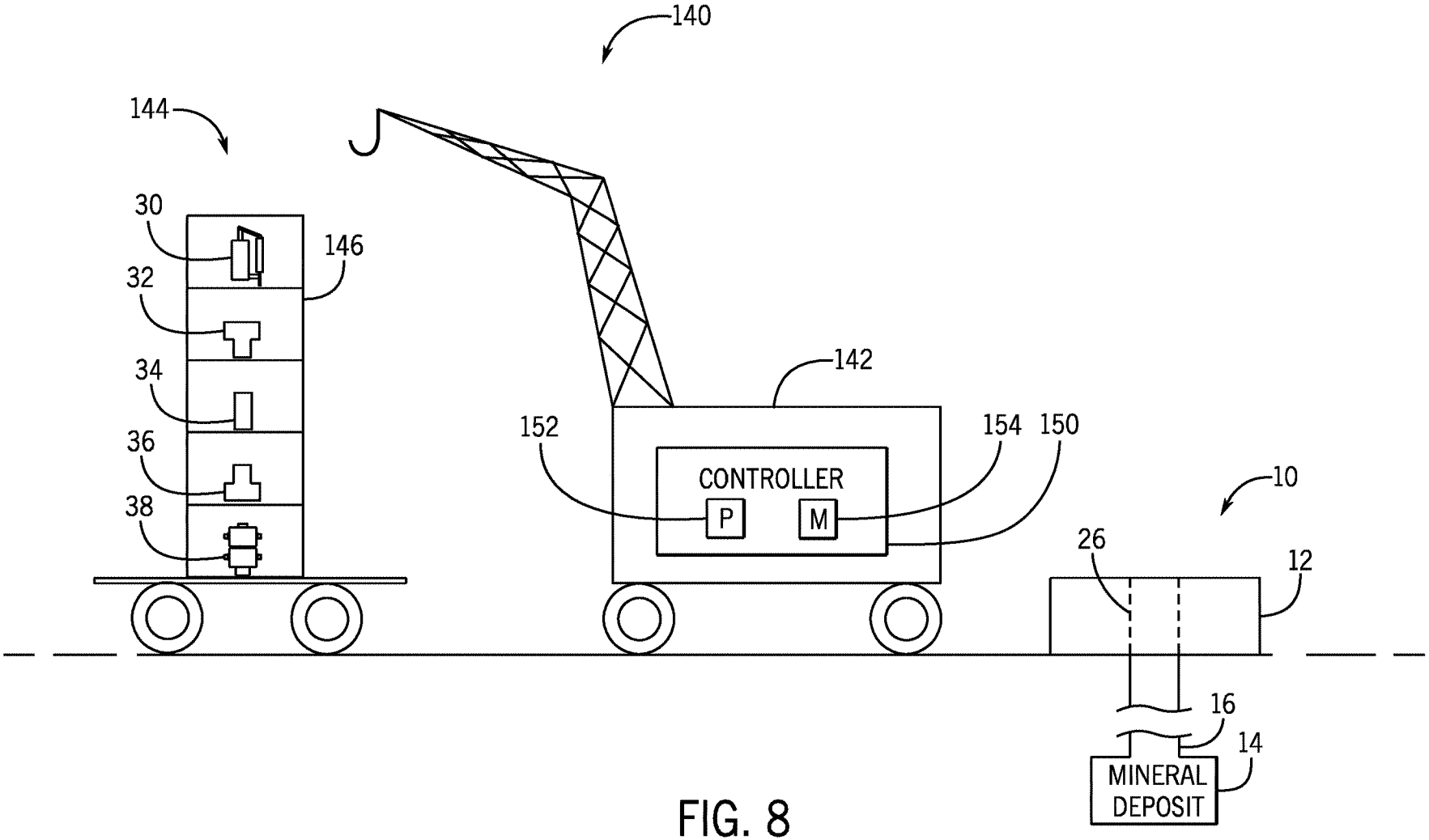
FIG. 8 is a perspective view of an embodiment of an automated crane system that may be utilized to assemble the PCE stack of FIG. 1.

FIG. 8 is a perspective view of an embodiment of an automated crane 140 that may be utilized to assemble the wireline PCE stack 18 (FIG. 1). As shown, the automated crane system 140 includes a crane 142 and a wireline PCE kit 144. The wireline PCE kit 144 may include various components that may be stacked on one another to form the wireline PCE stack 18. For example, the illustrated wireline PCE kit 144 includes the stuffing box 30, the tool catcher 32, the lubricator section 34, the tool trap 36, and the BOP stack 38. Each component may be supported in a separate portion or in a designated area within a box 146 (e.g., transport box or storage rack). For example, the components may be placed within the box 146 at manufacturing and/or prior to transport to the well. Each box 146 may have an identical arrangement (e.g., regardless of the well to which it will be transported) or each box 146 may have a unique arrangement. While the components are shown in a vertical arrangement within the box 146, it should be appreciated that the box 146 may be designed to support the components in other arrangements.

The crane 140 may include a controller 150 having a processor 152 and a memory 154. The processor 152 may be configured to retrieve (e.g., from the memory 154 or from another external storage) information related to the respective position of each component within the box 146. The processor 152 is configured to operate (e.g., autonomously operate) to lift each component from the box 146 and place each component on top of the wellhead 12 to form the wireline PCE stack 18. For example, the processor 152 may instruct the various actuators of the crane 142 to first lift the BOP stack 38 and position the BOP stack 38 on the wellhead 12, then to lift the tool trap 36 and position the tool trap 36 on the BOP stack 38, then to lift the lubricator section 34 and position the lubricator section 34 on the tool trap 36, and so forth, until the wireline PCE stack 18 is complete. In some embodiments, the lifting and positioning steps may be completely automated, and thus, the crane 142 may build the wireline PCE stack 18, including making some or all mechanical, electric, and hydraulic connections, without any inputs or control by the operator. To facilitate the automated construction in this manner, the components of the wireline PCE stack 18 may include lifting connections that are engaged by a lifting component (e.g., hook) of the crane 142. Furthermore, the components of the wireline PCE stack 18 may include stab-in connections to facilitate coupling the BOP stack 38 to the wellhead 12 and coupling the components to one another (e.g., mechanical, electric, and/or hydraulic coupling).

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The invention claimed is:

1. A system, comprising:

one or more processors configured to provide one or more control signals to cause supply of electric power from a power supply to one or more electric actuators that are configured to adjust one or more components of a cable pressure control equipment (PCE) stack, wherein a first control signal of the one or more control signals instructs supply of the electric power to a stuffing box actuator of the one or more electric actuators to adjust a packing material of a stuffing box of the one or more components, wherein a second control signal of the one or more control signals instructs supply of the electric power to a winch actuator of the one or more electric actuators to adjust a rate of rotation of a drum of a winch of the one or more components, and wherein a third control signal of the one or more control signals instructs supply of the electric power to a valve actuator of the one or more electric actuators to adjust a ram of a valve of the one or more components.

2. The system of claim 1, comprising the power supply.

3. The system of claim 1, comprising the one or more electric actuators and the one or more components of the cable PCE stack, wherein the one or more components comprise the stuffing box, the valve, and the winch.

4. The system of claim 1, comprising one or more sensors configured to monitor one or more conditions of the cable PCE stack and to provide one or more sensor signals indicative of the one or more conditions to the one or more processors.

5. The system of claim 4, wherein the one or more processors are configured to process the one or more sensor signals and to provide the one or more control signals based on the one or more sensor signals.

6. The system of claim 4, wherein the one or more sensors comprise a leak sensor, a pressure sensor, and a position sensor.

7. The system of claim 1, comprising a cable extending through the cable PCE stack, wherein the cable comprises a wireline, slickline, coiled tubing, or spoolable rod.

8. A system, comprising:

one or more processors configured to provide one or more control signals to cause supply of electric power from a power supply to one or more electric actuators that are configured to adjust one or more components of a cable pressure control equipment (PCE) stack, wherein the one or more processors are configured to receive a leak signal from a leak sensor, determine whether a leak is present based on the leak signal, and provide a stuffing box control signal of the one or more control signals to supply the electric power to a stuffing box actuator of the one or more electric actuators to adjust a packing material of a stuffing box in response to determining that the leak is present.

9. The system of claim 8, wherein the one or more processors are configured to receive a position signal from a position sensor, determine whether a plate of a tool trap is driven to an open position by a tool within the cable PCE stack based on the position signal, and provide a winch control signal of the one or more control signals to supply the electric power to a winch actuator to reduce a rate at which the tool is withdrawn from the cable PCE stack in response to determining that the plate is driven to the open position by the tool.

10. The system of claim 8, wherein the one or more processors are configured to receive a first pressure signal from a first pressure sensor, receive a second pressure signal from a second pressure sensor, determine whether a seal formed by rams of a first valve is adequate based on the first pressure signal and the second pressure signal, provide a cable control signal of the one or more control signals to supply the electric power to a valve actuator to move rams of a second valve to a respective closed position in response to determining that the seal formed by the first valve is inadequate.

11. The system of claim 8, comprising the power supply.

12. The system of claim 8, comprising a cable extending through the cable PCE stack, wherein the cable comprises a wireline, slickline, coiled tubing, or spoolable rod.

13. A method, comprising:

generating, using one or more processors, one or more control signals to cause supply of electric power from a power supply to one or more electric actuators that are configured to adjust one or more components of a cable pressure control equipment (PCE) stack;

generating, using the one or more processors, a first control signal of the one or more control signals to cause supply of the electric power to a stuffing box actuator of the one or more actuators to adjust a packing material of a stuffing box of the one or more components;

generating, using the one or more processors, a second control signal of the one or more control signals to cause supply of the electric power to a winch actuator of the one or more actuators to adjust a rate of rotation of a drum of a winch of the one or more components; and generating, using the one or more processors, a third control signal of the one or more control signals to cause supply of electric power to a valve actuator of the one or more actuators to adjust a ram of a valve of the one or more components.

14. The method of claim 13, comprising:

receiving, at the one or more processors, one or more signals from one or more sensors configured to monitor one or more conditions of the cable PCE stack;

determining, using the one or more processors, the one or more conditions of the cable PCE stack; and providing the one or more control signals based on the one or more conditions of the cable PCE stack.

* * * * *